United States Patent [19]

Lerman et al.

[11] 4,145,461

[45] Mar. 20, 1979

[54] PROCESS OF WARP SIZING WHICH USES A LOW MOLECULAR WEIGHT POLYESTER AND CHELATED TITANATE IN A WATER DISPERSION

[75] Inventors: Michael A. Lerman, Park Forest; John C. Lark, St. Charles, both of Ill.

[73] Assignee: Standard Oil Company (Indiana), Chicago, Ill.

[21] Appl. No.: 871,104

[22] Filed: Jan. 20, 1978

Related U.S. Application Data

[63] Continuation-in-part of Ser. No. 739,241, Nov. 5, 1976, abandoned.

[51] Int. Cl.[2] ..... B05D 3/02

[52] U.S. Cl. ..... 427/155; 260/29.2 E; 428/290; 428/394; 428/395; 428/483; 427/390 R

[58] Field of Search ..... 260/29.2 E; 427/390 R, 427/155; 428/290, 394, 395, 483

[56] References Cited

U.S. PATENT DOCUMENTS

| | | | |
|---|---|---|---|
| 2,334,107 | 11/1943 | Light et al. | 260/29.2 X |
| 2,378,230 | 1/1945 | Little | 260/29.2 X |
| 3,734,874 | 5/1973 | Kibler et al. | 260/29.2 X |
| 3,779,993 | 12/1973 | Kibler et al. | 260/29.2 X |
| 3,853,820 | 12/1974 | Vachon | 260/75 T |
| 4,016,330 | 4/1977 | Laganis | 260/29.2 X |
| 4,035,531 | 7/1977 | Lark | 427/390 R |
| 4,066,593 | 1/1978 | Czajka et al. | 260/29.2 E |

*Primary Examiner*—Michael R. Lusignan

*Attorney, Agent, or Firm*—William C. Clarke; Arthur G. Gilkes; William T. McClain

[57] ABSTRACT

A water dispersion comprising i) up to about 50% by weight of a water-dispersible low molecular weight polyester having a number average molecular weight in the range of about 850–2500 and preferably 1100–1800 and an acid value in the range of about 40–85 milligrams of KOH/gram of said polyester (millig/g) and preferably in the range of about 45–65 millig/g, which comprises: (1) a non-linear polyester backbone having an acid value in the range of about 5–15 millig/g and preferably about 8–12 millig/g comprising the reaction product of an aliphatic polyol, an aromatic dicarboxylic acid, and a monocarboxylic acid and (2) pendant moieties of a polycarboxylic acid having at least one free carboxylic acid group and at least one ester linkage to said backbone, ii) about 0.5% to 4% by weight, as based upon said polyester, of a chelated titanate, and iii) a fugitive base, is disclosed to provide a useful warp sizing composition for synthetic yarn fibers.

9 Claims, No Drawings

PROCESS OF WARP SIZING WHICH USES A LOW MOLECULAR WEIGHT POLYESTER AND CHELATED TITANATE IN A WATER DISPERSION

This is a continuation-in-part of application Ser. No. 739,241, filed Nov. 5, 1976, abandoned.

BACKGROUND OF THE INVENTION

1. Field of the Invention

This invention relates to the art of warp sizing compositions to be employed on synthetic textile yarns.

2. Prior Art

When textile fibers are to be used in the formation of multifilament yarns for the fabrication of textile materials, it is desirable for the weaving process to treat the warp yarn with a sizing composition which adheres to and binds the filaments together. This treatment renders the filaments resistant to abrasion damage during weaving operations. An example of abrasion damage is the severing of the filaments which in general lowers the quality of the final woven product and which if severe enough can interfere with production by requiring weaving stops.

Various materials have been suggested as sizes for yarns. However, some of these materials are not readily compatible with or do not adhere well to textile yarns and thus do not form a protective coating or film thereon. Other materials coat the yarn but do not impart more than a slight degree of abrasion resistance. Still other materials, while coating the yarn and imparting satisfactory abrasion resistance are removed from the woven fabric only with considerable difficulty and expense.

Traditional sizing materials utilized on natural fibers have not proven to be applicable to spun and filament yarns composed of 100% synthetic fiber due to a lack of adhesion of these materials to the synthetic fiber substrate. Materials to size 100% synthetic fiber have been developed based on polyacrylics and copolymers of vinyl acetate and maleic anhydride.

The primary objection to the current synthetic sizing materials has been a lack of adhesion between the size and the fiber substrate. This is especially apparent in attempts to size 100% polyester fiber. Eastman WD, as disclosed in U.S. Pat. No. 3,546,008 (1970), is available for sizing 100% polyester yarn. This is a relatively high molecular weight polyester polymer dispersed in water. It has excellent adhesion to the polyester yarn and provides excellent sizing performance. However, there are at least three objections to this material.

The first objection is that the size is so similar to the fiber substrate that any heat or aging of woven fabric sized with Eastman WD tends to couple the size to the fabric, and any permanent coupling of size and warp results in a fabric having fibers in the warp and fill direction which react differently to a particular dyestuff. This destroys the precise control necessary for uniform dying and other finishing operations.

The second objection is that pH and electrolyte control is necessary in a desize bath when scouring off Eastman WD Size. The chemical nature of WD size is such that it is precipitated or insolubilized by strong electrolytes, such as sodium hydroxide, hydrochloric acid, and sodium chloride or by highly concentrated solutions of relatively weak electrolytes. Further if a caustic boil-off is desired to smooth out the surface of the filament polyester yarn and to approach a silk-like hand, WD size should be removed in a prior desizing scour.

The third objection is that temperatures of the desize bath are optimally required to be in excess of about 180° F., in order to completely scour off the WD size within about 30 minutes. The higher the temperatures required for the desize bath, the more expensive is the process.

In general, the properties present in an ideal sizing formulation are:

1. It forms a film from a water dispersion;
2. It forms a stable water dispersion for at least 6 months at 72° F.;
3. The deposited film from said water dispersion is flexible;
4. It forms a non-tacky film at 65% relative humidity with air drying at room temperature in less than eight hours;
5. It has low sensitivity to moisture in that substantially no water is absorbed at 65% relative humidity at 72° F;
6. It forms a film having good adhesion to synthetic multifilament fibers;
7. It has substantially no blocking tendencies as determined according to ASTM D 1146-53; and
8. It forms a film which is easily removed by scouring with solutions which do not involve rigorous pH, electrolyte or temperature control and which film does not have heat setting or aging properties which can make said films difficult to scour off or remove.

BRIEF DESCRIPTION OF THE INVENTION

It is an object of this invention to provide a warp size which overcomes the problems discussed above and has all of the properties of an ideal size.

It is an object of this invention to provide a warp size for a variety of synthetic fibers.

It is an object of this invention to provide a warp size which can be easily removed from 100% spun or filament warps of synthetic fiber.

It is an object of this invention to provide a size which can be removed easily by scouring with mildly basic water solutions at 120° F. within 30 minutes.

It is an object of this invention to provide a warp size which does not require rigorous control over electrolyte balance, because said size is not precipitated or insolubilized by strong electrolytes, such as sodium hydroxide, hydrochloric acid, and sodium chloride or by highly concentrated solutions of relatively weak electrolytes.

It is an object of this invention to provide a warp sizing material which does not become so strongly coupled to a sized fabric which had been subjected to heat-setting prior to scouring that it is difficult to remove.

It is an object of this invention to provide a warp size which will permit scouring-off with baths having a pH in the range 7-13 and a temperature of about 120° F. or greater.

Other objects of this invention will be clear from reading the Specification of this invention.

The process of sizing is defined throughout this Specification and Claims to be the process of applying a sizing or a sizing compound as for example by means of a machine referred to in the weaving art as a slasher. A variety of such methods are well known in the art and can be used in this invention. The pick-up of size in this invention is preferably about 1%-10% by weight. With increasing pick-up, there generally is an increasing tackiness to the sized fibers. However, in the preferred range of pick-up, tackiness, if any, does not give rise to any weaving problems.

It has been found that the above objects can be achieved by the process of sizing with an aqueous composition comprising:

A. about 1–50% by weight of a low molecular weight water-dispersible polyester having a number average molecular weight in the range of about 850–2500 and preferably 1100–1800 and an acid value in the range of about 40–85 milligrams of KOH/gram of said polyester (millig/g) and preferably in the range of about 45–65 millig/g, which comprises: (1) a non-linear polyester backbone having an acid value in the range of about 5–15 millig/g and preferably about 8–12 millig/g comprising the reaction product of i) an aliphatic polyol wherein all the hydroxyl groups are preferably primary, ii) an aromatic dicarboxylic acid, and iii) a monocarboxylic acid and (2) pendant polycarboxylic acid moieties attached to said backbone by ester linkages wherein each pendant moiety has at least one free carboxylic acid group;

wherein the reaction product of all alcohols and acids include, as is apparent to one skilled in the art, known equivalent reactants to organic acids such as acid halides, acid anhydrides, esters and the like which will form the same reaction products when reacted with an alcohol as arise when reacting an acid with an alcohol;

B. about 0.5% to about 4% and preferably about 1% to about 3% by weight, as based upon the weight of said polyester resin present, of a water dispersible and water stable chelate of titanium capable of interacting with said polyester so as to form a non-tacky film; and C. up to about 50% by weight of water as based upon the total composition.

The number average molecular weights were those found by the Vapor Phase Osmometry method. It has been found that in general polyesters of the warp sizing composition described above having a number average molecular weight in the range 850–2500 gave rise to non-tacky films having good to excellent adhesion.

As is demonstrated in TABLE 14 of EXAMPLE 14, the observed tackiness of a film can be affected by the concentration of said polyester in the dispersion. In general, the higher is the polyester concentration, the more tacky is the 1.5 mil draw down film. In the case of a polyester having a number average molecular weight in the range of about 1100–1800, 1.5 mil draw downs gave non-tacky films from dispersions with said polyester in a concentration of up to 30%. In the case of polyesters having a number average molecular weight in the range of about 850 to about 1500, the concentration generally must be about 5% or lower for 1.5 mil draw downs to give a non-tacky film. Below about 850, films having polyester concentrations of about 5% or lower are always tacky. Polyesters, on the other hand, having a number average molecular weight above 2500 though generally non-tacky tend to form gels so as to seriously inhibit the formation of "stable" water dispersions.

The water in said aqueous composition is preferably substantially free of calcium ions or other ions which tend to form insoluble precipitates with free carboxyl groups as is well known in the art.

The reacted monocarboxylic acid in the low molecular weight polyester functions both as a self-plasticizing agent to ensure flexibility in a polyester film deposited from the warp sizing composition and to aid in the water-dispersibility of the polyester.

The aliphatic chain length of said monocarboxylic acid determines both the degree of self-plasticization and the resistance to phase separation of the warp sizing composition. If for example, the chain length of the acid is not long enough, then the polymer in a water dispersion has a tendency to agglomerate and to form a separate phase. The formation of a separate phase interferes with the process of depositing a uniform film from said water dispersion. If, on the other hand, the aliphatic chain length of said acid is too long, then a film deposited from its water dispersion tends to be tacky (as determined by the method of Example 4) and may block (as determined according to ASTM D1146–53).

It is to be noted that the aliphatic chain is preferably saturated rather than unsaturated because it has been found that in the drying operation of warp fibers, there is an increasing tendency for the low molecular weight ester to adhere to conventionally used metal slasher can rather than the warp fibers when there is an increasing amount of non-benzenoid unsaturation present. This problem usually occurs when there is a stoppage in the process. If the amount of non-benzenoid unsaturation is sufficiently low, however, the problem of adherence to slasher cans is minimal.

It has been found that the stability of the dispersion is satisfactory when a linear aliphatic monocarboxylic acid has from 4 to 23 carbon atoms. Increasingly below 4, the dispersion becomes very unstable. Increasingly above 23, a deposited film becomes very tacky. It has been found that in the case of the phenyl derivative of a linear aliphatic monocarboxylic acid the chain length therein provides good plasticization and dispersion stability where said aliphatic chain has from 1 to 12 carbon atoms. However, optimum properties for dispersion stability and tack-free films are obtained when the phenyl derivative has an aliphatic chain length of 5 to 7 carbon atoms. As the number of carbons goes from 5 to 1, the dispersion becomes increasingly unstable, and as said number increases from 7 to 12, a film deposited from said dispersion becomes increasingly tacky.

The diacid moiety of the polyester backbone can be either substituted or unsubstituted. Inert groups such as, for example, halogens and/or aliphatic groups can be used as aromatic substituents. It is to be noted however, that with increasing chain length of said aliphatic groups there is a tendency of the dry deposited film increasingly to be tacky and therefore more likely to block. It is further to be noted that aliphatic groups containing no non-benzenoid unsaturation are preferred for the reasons discussed previously. The diacid is preferably aromatic because in general non-benzenoid diacids give rise to tacky films.

The polyol preferably is a triol having primary hydroxyl groups. Secondary aliphatic alcohols in general are not reactive enough to form polyesters of sufficient length to be able to form good films. Primary diols, on the other hand, tend to form polyesters whose films on drying are tacky. Examples of aliphatic primary triols which can be used are primary triols selected from the group consisting of 1,1,1-trimethylol ethane, 1,1,1-trimethylol propane, trimethylol butane, trimethylol pentane, trimethylol hexane, trimethylol septane, trimethylol octane, 1,1,2-trimethylol ethane, 1,1,2-trimethylol propane, 1,2,2-trimethylol propane, 1,2,3-trimethylol propane, and the like.

The pendant polycarboxylic acids are incorporated so that at least one ester linkage and at least one free carboxylic acid group for each polycarboxylic acid moiety is produced in the polyester of the warp sizing composition. A method for so incorporating such a moiety is discussed in more detail hereinafter and in the examples. Cyclic acid anhydrides can be reacted under controlled conditions involving both temperature and reaction time to form an ester linkage and a free carboxylic acid group. Also under these controlled conditions, free carboxylic groups in either reactants or products do not further react to form ester linkages. Examples of aromatic cyclic acid anhydrides particularly useful in this reaction are trimellitic acid anhydride (TMA), phthalic anhydride, and polyaryl anhydrides such as, for example, 1,2-naphthalene dicarboxylic acid anhydrides. It has been discovered that trimellitic acid anhydride gives rise to low molecular weight ester films which have particular affinity for polyesters. It is believed that this affinity is in part the result of the aromatic ring of the trimellitic acid which has an affinity for the aromatic rings in the polyester of the synthetic fiber substrate.

Other acid anhydrides useful for forming pendant groups in this invention include cyclic aliphatic acid anhydrides containing up to 8 carbon atoms. Examples of cyclic aliphatic acid anhydrides are maleic, malonic, succinic, gluteric, adipic, and pimilic anhydrides and the like. It is to be noted that the aliphatic acid anhydrides are preferably saturated, for the reasons discussed previously.

Generally, the polyester of this invention comprises a backbone which is a reaction product of an aliphatic polyol, an aromatic diacid, and a monocarboxylic acid and to which are attached by means of ester linkages polycarboxylic acids wherein each polycarboxylic acid gives rise to at least one free carboxyl group.

In somewhat greater detail, the backbone for the polyester of this invention, which has an acid value in the range 5–15 millig/g and preferably in the range 8–12 millig/g, comprises a reaction product of an aliphatic polyol wherein all hydroxyls are preferably primary, an aromatic diacid, and a monocarboxylic acid, wherein a ratio for the total equivalents or moles of all hydroxyl groups in said polyol to the total equivalents or moles of the carboxyl or acyl groups in both said aromatic diacid and monocarboxylic acid or their equivalents in in the range of about 1.3:1 to about 1.6:1 and preferably in the range of about 1.35:1 to about 1.55:1. As said ratio goes from 1.35:1 to 1.3:1 there is an increasing tendency to form a gel on addition of TMA. As said ratio goes from 1.55:1 to 1.6:1, both air drying and dispersion stability characteristics rapidly deteriorate. (See EXAMPLE 7.)

In somewhat greater detail, the polyester of this invention, which has an acid value in the range 40–85 millig/g and preferably 45–65 millig/g, has a ratio for the total equivalents or moles of hydroxyl groups of all alcohols to the total moles of the all acid or acid equivalent groups of all acids or their equivalents prior to being incorporated into said polyester of this invention in the range of about 1:1 to about 1.2:1. As said ratio decreases below about 1:1 to about 0.9:1, there is an increasing tendency to form a gel. As said ratio increases from about 1.2:1 to about 1.3:1 both air drying and dispersion stability characteristics deteriorate rapidly. (See EXAMPLE 7).

The chelated titanium compound is preferably water soluble but optionally may be merely water dispersible.

The two ligands used to chelate the titanium must be sufficiently stable so as not to undergo reaction either with water or the polyester prior to deposition from solution as a film. Stable chelate rings, including the titanium ion, are formed preferably having five to six members. Excessively larger or smaller rings tend to be unstable. Examples of chelating ligands are those having two titanium ion reactive groups present in the same molecule. Some examples are diols, diamines, an amine with an alcohol, an acid with an alcohol, an acid with an amine, and an acyl or keto group with either an acid or an ester group. It has been found that the amine with an alcohol chelate tends to form more stable water dispersions than do any of the other cited chelating ligands. It is possible to use most chelated titanates regardless of their long term stability in a water dispersion provided they are added to the dispersion shortly before a film is to be deposited.

Two remaining ligands associated with the titanium are replaceable when the molecule is heated due to inherent volatility. An example of replaceable ligands which will permit cross-linking of the low molecular weight polyesters discussed above are secondary alcohols such as isopropyl alcohol and the like. The nature of these replaceable groups is that as a pure substance they have a sufficiently high vapor pressure to provide a thermodynamic impetus to reaction; i.e., the greater the volatility of the replaceable ligand the more reactive the replaceable group tends to be.

The function of the chelated titanate is both to improve the adhesive strength between the polyesters of this invention and a substrate of synthetic fiber yarns, and to improve the dried film properties with respect to tackiness and blocking (see TABLE 9 of EXAMPLE 10). The means by which the chelated titanate achieves the above results is believed to be by cross-linking at least some of the low molecular weight polyesters of this invention. The important feature of this invention is that although a water resistant and strongly adhering film to synthetic fiber yarns is achieved, this film can be readily desized. It is not known precisely why these polyesters especially after being cross-linked can be so easily desized. Since polyesters which have an affinity to form strong physical bonds especially with polyester substrates tend to become permanently bonded especially after heat-setting. It is not known, but believed unlikely, that the polyester once cross-linked will under the influence of a base become uncross-linked.

Strongly adhering non-tacky and water resistant flexible films which are readily desizable can be made by this invention for a wide variety of homo and copolymers in the form of a mono or multifilament synthetic fibers. Examples of such fibers are polyesters, polycarbonamides, and polyolefins such as, for example, polymers of 1-olefins of up to 8 carbon atoms. Generally, a 1% to 50% and preferably 5% to 10% dispersion of the polyester of this invention can be used to size synthetic warp fibers which generally pick-up from about 1% to 10% solids by weight of size. These sized warp fibers can then be readily woven into a fabric which can be heat-set prior to desizing. The process of desizing is carried out in a bath containing a basic water solution and optionally a detergent such as a nonionic surfactant. One particularly desirable feature of this invention is that complete desizing by scouring in baths at temperatures as low as 120° F. can be readily carried out in 30 minutes. Higher temperatures can also be used but, based on economic considerations, processing temperatures as low as 120° F. are particularly advantageous. For purposes of comparison bath temperatures recommended to desize Eastman WD are in excess of about 180° F. Another very desirable feature of this invention is that rigid electrolyte control of the desizing bath to avoid precipitating the polyester of this invention is not required. For example, scour baths containing either 2 g/l of sodium hydroxide or 2 g/l of soda ash both desize equally well at about 160° F. It is to be noted that the more basic the scour bath, the generally lower can be the temperature of said bath without loss in desizing effectiveness or efficiency.

It is to be noted that both tackiness and blocking discussed hereinbefore which arises from any aliphatic chains incorporated in the water dispersible polyester can be reduced by the addition of about 1% to 20% by weight as based upon said water dispersible polyester of a hard film forming resin. This resin is defined to have a high acid value in excess of about 100 millig/g, a softening point (ASTM E28-67) in the range of about 100-200° C., to be soluble in basic water, and to be only partially, if at all, solution compatible with the polyester of this invention in the absence of a fugitive base or other components giving rise to a basic environment. The importance of this partial to total incompatability arises from the fact that when the dispersion is dried to a film and any fugitive base volatilizes off, a separation between the hard resin and said water dispersible polyester must occur. Because of this separation, the hard resin during drying tends to bloom to the surface thereby forming a barrier film which is tack-free and water resistant. This film, though imparting water resistance, as measured by moisture regain of a 140° F. oven dried film subjected for 24 hours to 70% relative humidity at 72° F., does not interfere with desizing, provided there is a sufficient number of free carboxyl groups as indicated by the acid value. Too great a concentration of hard resin, however, can result in undesirably brittle films and decreased adhesion.

Compatibility of a hard resin in a water dispersion at a pH in the range 7-13 is measurable by determining whether after a period of time on the order of 24 hours a phase separation has occurred. This phase separation involves the hard resin either settling out of the dispersion as a precipitate or forming a hazy or cloudy color throughout the dispersion. A dispersion of a compatible hard resin and low molecular weight polyester is one which is clear and remains so without formation of any precipitates. Examples of such hard resins are Pentalyn$^R$ 255.

One reaction sequence which can be utilized to form a polyester useful in this invention involves a two phase reaction sequence referred hereinafter as phase 1 and phase 2 as discussed in Example 1. In phase 1, the backbone of the low molecular weight polyester of this invention is formed. In phase 2, additional acid groups as pendant acids to the polyester are introduced which improve both water dispersibility and film properties.

It has been found that, in phase 1, a ratio of the moles of carboxyl acid groups from the monocarboxylic acid to the moles of carboxyl acid groups from the aromatic dicarboxylic acid determines in part the molecular weight of the polyester formed and more importantly has an impact both on the tackiness of deposited titanate cross-linked polyester film and the stability of a dispersion made with said polyester. A polyester having said ratio in the range of about 0.30:1 to about 0.48:1 and preferably about 0.31:1 to about 0.45:1 has good dried film characteristics with respect to adhesion, tackiness and blocking. Much outside this range, the polyester film tends to be tacky.

A ratio of the total equivalents or moles of the reactive primary hydroxyl or alcohol groups from the aliphatic polyols of phase 1 to the total equivalents or moles of all reactive acid groups from both the monocarboxylic acid and the aromatic dicarboxylic acid, both of phase 1, is in the range of about 1.3:1 to about 1.6:1 and preferably in the range of about 1.35:1 to about 1.55:1. At the lower end of the range the reaction mixture has a tendency to gel upon the addition of trimellitic anhydride in phase 2. It is believed that because of the limited number of reactive alcohol groups there occurs extensive cross-linking, and hence a gelling. At the upper end of the range, a deposited and air dried film tends to be tacky and a water dispersion containing said polyester tends to be less stable, i.e., has a tendency to separate into phases.

The acid value in phase 2 of the low molecular weight polyesters of this invention has a significant effect on the tackiness of air dried films. Acid values as determined according to ASTM D 1639-70 in the range of 40-80 milligrams of KOH/gram of low molecular weight polyester (millig/g), and preferably in the range of 65-67 millig/g, were found to be substantially tack free. It has also been found that to a lesser extent in the acid value determined in phase 1 also has an impact on the tackiness of air dried films and the ability of a water dispersion. It is to be noted that the acid value of phase 1 is an indication of the molecular weight of the backbone of the polyester. In general, the lower is the acid value, the larger is the molecular weight of the polyester. If the molecular weight is too low, as for example when the acid value in phase 1 is 17 millig/g and about 60 millig/g in phase 2, then an air dried (72° F.) film is tacky, although the adhesion to PET and the dispersion stability are both good. If on the other hand, the molecular weight is too high, then the stability of the water dispersion decreases. Acid values for phase 1 in the range of about 5-15 millig/g and preferably about 8-12 millig/g work well.

The room temperature (72° F.) stability of water dispersions having 30% non-volatile material and comprising the low molecular weight polyesters of this invention have been found to be at least 24 weeks. However, at higher temperatures such as 120° F., such dispersions without any provision for improving their stability have been found to be much less stable and in fact becoming cloudy within 2 weeks and failing to be useful as a sizing dispersion within 6 weeks. The significance of the cloudiness is that the dispersions of this invention are initially clear, but as they break down, they become more and more cloudy and simultaneously more and more viscous. It has been discovered, however, that the stability of these solutions can be considerably improved by freezing. (See EXAMPLE 15.)

DETAILED DESCRIPTION OF THE INVENTION

EXAMPLE 1—PREPARATION OF THE LOW MOLECULAR WEIGHT POLYESTER

Phase 1

Into a three-liter reaction vessel equipped with stirrer set at a rate of 5 rpm and means for gas sparging, add 1.275 moles of pelargonic acid and 2.48 moles of trimethylol propane. The reaction vessel was heated to 150° F. under 0.3 standard cubic feet per minute of nitrogen sparge.

When the reaction vessel has reached 150° F., 1.8 moles of isophathalic acid having a purity of 85% is added and the heating is continued to 340° F. When 340° F. is reached, the heating is continued to 450° F. over a four to five hour period.

The 450° F. temperature is maintained until an acid value of 5–8 millig/g is obtained for the polymer in the reaction vessel. After an acid value of 5–8 millig/g is obtained, the reaction mass is cooled to 340° F., utilizing a water jacket. This point ends phase 1.

Phase 2

0.52 Moles of trimellitic acid anhydride is added to the reaction vessel. The temperature is maintained in the range of 340°–350° F. in order to maintain the presence of a free acid group and until an acid number of 62–65 millig/g is obtained, and then the reaction vessel was cooled to 280° F.

During this cooling process, isopropyl alcohol was added until 75% non-volatile solution is obtained. To this isopropyl alcohol solution add slowly aqueous ammonia so as to completely neutralize all carboxyl groups and then continue adding aqueous ammonia until an excess of about 50% ammonia has been added. The resulting neutralized resin solution is to be stirred thoroughly.

Distilled water in small increments of roughly 5 grams each are added with thorough stirring. It is to be noted that as distilled water is initially added the neutralized resin dispersion becomes very thick and translucent. However, as a 30% resin solids dispersion is approached, it begins to thin out. When about 50 grams of water has been added then 0.3 grams of Tyzor TE (1% on ester resin) is added with careful and thorough stirring. The final amount of distilled water and/or 28% aqueous ammonia to produce a 30% solution having an adjusted pH of about 8–9.5 is then added with stirring.

A 30% solution of ester resin with 1% Tyzor TE based thereon (TABLE 1) having a pH adjusted with 28% ammonia to 8–9.5 has a viscosity in th range 20–60 cps.

TABLE 1

40 grams isopropyl-resin solution
30 grams ester 10 grams isopropyl alcohol
About 4 grams aqueous ammonia 28%
0.3 grams Tyzor TE
55.7 grams of distilled water.

EXAMPLE 2—EQUIVALENCE OF TEREPHTHALIC ACID, ISOPHTHALIC ACID AND PHTHALIC ACID IN THE PREPARATION CITED IN EXAMPLE 1

It has been found as shown in TABLE 2 that, in the reaction disclosed above, phthalic acid (PA), isophthalic acid (IPA) and terephthalic acid (TA) can be used interchangeably. So that it is clear in general any aromatic dicarboxylic acids can be used.

However, aliphatic dicarboxylic acids in general cannot be substituted for the above aromatic dicarboxylic acids. This is shown in TABLE 2 where maleic anhydride was substituted for the aromatic dicarboxylic acid. The resulting polyester gave extremely tacky films. No test for adhesion or stability was run.

TABLE 2

| Polyester Containing Moieties of: | Moles | Acid Value (millig/g) (Phase 2) | Dispersion** Stability | Tackiness of Film | Adhesion* to PET |
|---|---|---|---|---|---|
| Pelargonic acid<br>IPA<br>TMP<br>TMA | 1.275<br>1.80<br>2.48<br>0.52 | 65.0 | stable | very slight tackiness | excellent |
| Pelargonic acid<br>PA<br>TMP<br>TMA | 1.275<br>1.80<br>2.48<br>0.52 | 65.2 | stable | very slight tackiness | good |
| Pelargonic acid<br>TA (fiber grade)<br>TMP<br>TMA | 1.275<br>1.80<br>2.48<br>0.52 | 66.3 | stable | very slight tackiness | excellent |
| Pelargonic Acid<br>Maleic Anhydride<br>TMP<br>TMA | 1.275<br>1.80<br>2.48<br>0.52 | 83.8 | — | extremely tacky | — |

*See Example 4 for description of test and meaning of results.
See note of TABLE 3.

EXAMPLE 3—THE EFFECTIVENESS OF DESIZING

The completeness of removal by scouring of a sizing composition from a test fabric was determined as follows:

Immerse for 1 minute a test fabric in one of several gently stirred scour baths consisting of 2 g/liter of a surfactant such as Dextrajet Scour 99, and either 2 g/liter or 10 g/liter of soda ash, or about 2% sodium hydroxide, and enough soft water to provide a 60/1 liquor to goods ratio. The bath is at one of the following temperatures: 120° F., 130° F., 150° F., or 180° F.

After removal from scour bath and wringing off excess scour bath liquid by hand, immerse for 1 minute a test fabric in a gently stirred soft water rinse bath having a 60/1 liquor to goods ratio. The rinse bath is at the temperature of the scour bath.

After removal from rinse bath and wringing off excess rinse bath liquid by hand, immerse the test fabric for 1 minute in a mildly agitated dye bath with a pH of 6.0–7.0 adjusted by means of sodium hydroxide consisting of 1 g/liter of Astrazon Blue liquid 50 (Verona) and enough soft water to provide a 60/1 liquor to goods ratio. The dye bath is at about 70° F.

After removal from dye bath, immerse the test fabric for 1 minute in a mildly agitated rinse bath consisting of 10% acetic acid and 2 g/liter Triton X-100 and enough soft water to provide a 60/1 liquor to goods ratio. The rinse bath is at room temperature.

After removal from rinse bath, the test fabric is rinsed for 1 minute under hot tap water (about 120° F.) and air dried.

The depth of blue color over the total surface of the test fabric indicates the amount of size present. In all cases considered, substantially all of the size was removed.

EXAMPLE 4

The tests followed to determine the adhesiveness of a polyester film to a polyethylene terephthalate fiber grade (PET) substrate and also the tackiness thereof are described hereinafter.

All tests used a 1.5 mil draw down rod to apply a 5% solids solution prepared as described in Example 1 onto a 0.005" thick by 3" wide by 6" long PET substrate. The resulting draw down was air dried at 72° F. for about 4 hours.

To determine tackiness, a dry acetone cleaned finger was applied with a force of about 5 lbs. for about 1 second to the air dried draw down. Some feeling of tackiness if any can be detected while pressure was being applied. As one releases pressure and lifts one's finger, the degree of tackiness can be determined as follows: "nontacky" indicates that there is no detectable tendency for the coated PET substrate to stick to one's finger, "very slight tackiness" indicates a tendency for the coated PET substrate to stick to one's finger for less than a second as one releases pressure and slowly lifts one's finger, "slight tackiness" indicates a tendency for the coated PET substrate to stick to one's finger for longer than a second but less than about three seconds, and "tacky" indicates there is a significant tendency for the substrate to stick to one's finger well in excess of three seconds.

It is to be noted that if there is a significant tackiness detected, the possibility of substantial blocking as determined according to ASTM D1146-53 is very likely.

The adhesive strength of the air dried polyester film to said PET substrate was determined by holding the coated substrate in each hand between the finger tips and palm, and rotating one hand in relation to the other to cause crinkling but no creasing of the PET substrate. "Excellent" adhesion indicates that there was neither any separation of the film from the PET substrate nor any crack formation. "Good" adhesion indicates that there is some minor amount of crack formation observed but no separation of any portion of the film from the substrate. "Poor" adhesion indicates any condition less than "good" as, for example, either excessive cracking, and/or some separation.

EXAMPLE 5

The optimum chain length of the saturated aliphatic chain of the monocarboxylic acid was determined by beginning with the optimum formulation and substituting different monocarboxylic acids and observing the effect of various carboxylic acids both on the film formed from said polyester and upon the stability of the dispersion.

TABLE 3 indicates the results in seeking to determine the optimum chain length of a saturated aliphatic chain of the monocarboxylic acid and also discloses examples of cyclic anhydrides in place of TMA. It is to be noted that one of the substitutes for TMA, maleic anhydride, is aliphatically unsaturated.

TABLE 3

| Polyester Containing Moieties of: | Moles | Acid Value millig/g (Phase 2) | Dispersion Stability | Tackiness of Films | Adhesion to PET |
|---|---|---|---|---|---|
| Pelargonic Acid (PA) | 1.275 * | 65.0 | | | |
| Isophthalic Acid | 1.80 | | stable** | very slight tackiness | excellent |
| Trimethylol Propane (TMP) | 2.48 | | | | |
| Trimellitic Acid Anhydride (TMA) | 0.52 | | | | |
| Stearic Acid*** | 1.275 | 55.0 | | | |
| IPA | 1.80 | | stable** | tacky | excellent |
| TMP | 2.48 | | | | |
| TMA | 0.52 | | | | |
| Adipic Acid | 1.275/2 | | | | |
| IPA | 1.80 | | resin gelled in phase 1 | | |
| TMP | 2.48 | | | | |
| TMA | 0.52 | | | | |
| Empol$^R$ 1010 diacid**** | 1.275/2 | | | | |
| IPA | 1.80 | | resin gelled in phase 1 | | |
| TMP | 2.48 | | | | |
| TMA | 0.52 | | | | |
| PA | 1.275 | | | | |
| IPA | 1.80 | 65 | stable | nontacky | good |
| TMP | 2.48 | | | | |
| Maleic Anhydride | 0.52 | | | | |
| IPA | 1.80 | 65 | stable | nontacky | good |
| TMP | 2.48 | | | | |

TABLE 3-continued

| Polyester Containing Moieties of: | Moles | Acid Value millig/g (Phase 2) | Dispersion Stability | Tackiness of Films | Adhesion to PET |
|---|---|---|---|---|---|
| Succinic Anhydride | 0.52 | | | | |

*Optimum Formulation
**Stable means that a 30% solution as made in Example 1 when stored at 120° F does not separate into phases within about 4 weeks.
***This composition with valeric acid in place of stearic acid was made as described in Example 1 except that in place of isopropyl alcohol as cosolvent, a mixed cosolvent of about 10% monobutyl ether of ethylene glycol and about 90% isopropyl alcohol is used.
****Empol$^R$ 1010 is a $C_{36}$ aliphatic dibasic acid sold by Emery Industries, Inc. and characterized in a publication entitled Empol$^R$ Dimer and Trimer Acids, Copyright 1971, Emery Industries, Inc., incorporated herein by reference.

When valeric acid was substituted for pelargonic acid the resin gelled upon addition of the isopropyl alcohol cosolvent. Substitution of a modified cosolvent, disclosed in a footnote to TABLE 3, avoided the gelling problem. It is believed that shorter chain monocarboxylic acids can be used provided the necessary cosolvent adjustment is made.

Substitution of stearic acid for pelargonic acid gave rise to a formulation which deposited a film having excellent adhesion. However, the film was tacky on drying.

Substitution of either adipic acid or Empol$^R$ 1010 diacid in place of pelargonic acid resulted in a gel in phase 1. This indicates that diacids cannot be substituted for the monocarboxylic acid.

EXAMPLE 6

In phase 1, the mole ratio of pelargonic acid functional groups to isophthalic acid functional groups is given in TABLE 4. It is to be noted that the acid values (ASTM D 1639-70) for all polyesters were within the optimum range of 60–80.

TABLE 4

| The Ratio of the Moles of Pelargonic Acid Twice the Moles of Isophthalic Acid | Dispersion Air Drying (72° F) Characteristics of Film | Characteristics* |
|---|---|---|
| 0.247 | poor | poor |
| 0.292 | poor | poor |
| 0.354 | excellent | stable |
| 0.475 | poor | poor |
| 0.625 | poor | poor |
| 1.471 | poor | poor |

*"Stable" means that a 30% solution as made in Example 1 when stored at 120° F does not separate into phases within about 4 weeks.
*"Poor" means that the above described solution does separate into phases within about 4 weeks but not within about 2 days.
"Bad" means that the above described solution does separate into phases within about 2 days.

From the table it is clear that the optimum range for said ratio is between about 0.3 to 0.47, with a preferable ratio in the neighborhood of 0.35.

EXAMPLE 7

The effect of the ratio of the total equivalents or moles of hydroxyl groups to the total equivalents or moles of acid groups upon the polyester formed is determinable from TABLES 5 and 6.

TABLE 5

| The Ratio of Total Moles of (OH) functionality to Total Moles in Phase 1 of ($CO_2H$) Functionality | Air Drying (72° F) Characteristics of Film* | Dispersion Characteristics** |
|---|---|---|
| 1.292 | gelled after TMA addition | |
| 1.385 | excellent | stable |
| 1.526 | excellent | stable |
| 1.649 | poor | poor |

TABLE 6

| The Ratio of Total Moles of (OH) functionality to Total Moles in Phase 1 and Phase 2 of ($CO_2H$) functionality | Air Drying (72° F) Characteristics of Film* | Dispersion Characteristics* |
|---|---|---|
| 0.97 (gel) | — | — |
| 1.05 | excellent | stable |
| 1.10 | good | stable |
| 1.15 | good | stable |
| 1.20 | less than good | poor |
| 1.25 | much less than good | bad |

*See footnote to TABLE 4.

It is clear from TABLE 5 that a ratio of hydroxyl to acid groups of 1.292 is not sufficient because the resin gelled. It is believed that the reason that the resin gelled was that there were insufficient amounts of hydroxyl or alcohol groups so that there was too much cross-linking. On the other hand, a ratio of 1.649 (TABLE 5) was unsatisfactory because the drying characteristics of the film were poor and the solution stability was poor. Based upon TABLE 5, it is clear that a ratio in the range of about 1.3:1 to about 1.6:1 is desirable.

It is clear from TABLE 6 that a ratio of all alcohol to all acid groups of about 1:1 to about 1.2 is desirable.

EXAMPLE 8

The nature of the polyol which is most useful in this invention was determined by substituting various polyols in the ideal formulation and observing the film characteristics resulting therefrom. TABLE 7 indicates the effect of various polyols when substituted in the ideal formulation.

TABLE 7

| *Polyester Containing Moieties of: (moles) | Acid Value (Phase 2) | Dispersion Stability | Tackiness of Films | Adhesion to PET |
|---|---|---|---|---|
| PA (1.275)<br>IPA (1.80)<br>TMP (2.48)<br>TMA (0.52) | 65 | good | very slight tack | excellent |
| PA (1.275)<br>IPA (1.80)<br>Neopentyl Glycol (3.72)<br>TMA (0.52) | 51.6 | white | very opaque | poor tacky |
| PA (1.275) | | | | |

TABLE 7-continued

| *Polyester Containing Moieties of: (moles) | Acid Value (Phase 2) | Dispersion Stability | Tackiness of Films | Adhesion to PET |
|---|---|---|---|---|
| IPA (1.80)<br>Trimethylol Ethane (2.48)<br>TMA (0.52) | 68.5 | good | slight tack | excellent |
| PA (1.275)<br>IPA (1.80)<br>Diethylene Glycol (3.72)<br>TMA (0.52) | 64.8 | good | tacky | excellent |
| PA (1.275)<br>IPA (1.80)<br>Propylene Glycol (3.72)<br>TMA (0.52) | 67.8 | very thin and unstable | very tacky | poor |
| PA (1.275)<br>IPA (1.80)<br>Pentaerythritol (0.93)<br>Neopentyl Glycol (1.86)<br>TMA (0.52) | 64.3 | good | very tacky | excellent |

*The total number of moles of all hydroxyl or alcohol functional groups is held constant at 7.44 moles.

It was clear that polyols having only primary hydroxyl groups were to be preferred. It was clear that primary diols as exemplified by neopentyl glycol, propylene glycol and diethylene glycol gave rise to tacky films.

Stable solutions and films having very low tackiness and excellent adhesion were obtained from primary aliphatic triols of trimethylol ethane and trimethylol propane.

EXAMPLE 9

The optimum concentration of isophthalic acid was determined by varying the isophthalic acid concentration in the optimum formulation. TABLE 8 indicates the results.

Table 8

| Moles of IPA* | Acid Values (Phase 2) | Dispersion Stability | Tackiness of Film | Adhesion to PET |
|---|---|---|---|---|
| 1.80 | 65.0 | good | very slight tackiness | excellent |
| 2.18 | Resin gelled prior to addition of TMA | | | |
| 1.02 | 82.2 | poor | tacky | excellent |

*The total composition is made as disclosed in Example 1 and contains 1.275 moles of PA, 2.48 moles of TMP, and 0.52 moles of TMA except that in the case of 1.02, 1.04 moles of TMA were used.

EXAMPLE 10

The optimum titanate level was determined based upon the information in TABLE 9. The resin composition dispersion given in TABLE 1 was made as disclosed in Example 1 except that the percent by weight as based on the weight of polyester of the Tyzor TE was varied.

TABLE 9

| % Titanate Level | Adhesion*** | | Surface Tack*** | |
|---|---|---|---|---|
| | Air Dry* | Oven Dry** | Air Dry* | Oven Dry** |
| 0.25% | very good | very good | slight | slight |
| 0.50% | very good | very good | slight | slight |
| 0.75% | very good | excellent | slight | none |
| 1.0% | excellent | excellent | none | none |
| 2.0% | excellent | excellent | none | none |
| 3.0% | excellent | excellent | slight | none |
| 4.0% | excellent | excellent | slight | none |
| 5.0% | excellent | excellent | slight | none |
| 10.0% | excellent | excellent | slight | slight |

*The air drying was at 72° F for 4 hours.
**The oven drying was at 210° F for 0.25 hours.
***For a description of the test, see Example 4.

It is believed that the less satisfactory adhesion of the film to PET of Tyzor TE of below 1.0% is due to an insufficient degree of cross-linking. It is believed that the tackiness observed at higher concentrations of Tyzor TE above 3.0% is due to excess triethanolamine titanate present in the film which has a tendency to pick up water.

EXAMPLE 11

The optimum acid value for the polyester in phases 1 and 2 prepared as described in Example 1 are determinable from TABLES 10 and 11. The acid value was determined according to ASTM D 1639-70.

TABLE 10

| Acid Value | | Air Dried Film (72° F) | |
|---|---|---|---|
| Phase 1 | Phase 2 | Tackiness | Adhesion |
| 9 | 65 | nontacky | excellent |
| 17 | 66.2 | very tacky | good |

TABLE 11

| Acid Value** | 72° F Air Dried Film Properties* |
|---|---|
| 60.0 | good |
| 62.8 | excellent |
| 64.8 | excellent |
| 65.2 | excellent |
| 65.5 | excellent |
| 67.3 | excellent |
| 71.5 | good |
| 75.5 | slight tackiness and good adhesion |

*Properties apply to both tackiness and adhesion unless otherwise specified expressly.
**Acid value of phase 1 in all cases was about 7 millig/g.

EXAMPLE 12

A solution of the sizing composition, disclosed in TABLE 1 and prepared by the method disclosed in Example 1, were subjected to aging at various temperatures. Both the solution stability as measured by its resistance to forming separate phases and/or to changing its pH and the concurrent properties of both adhesion and tackiness were investigated. It is to be noted that, in order to achieve cross-linking upon application and evaporation of solvent vehicle of the disclosed sizing compositions, a fugitive base, such as ammonia in water, is required.

TABLES 12 and 18 establish that:

(1) oven aging at 120° F. of the 30% composition of Example 1, TABLE 1, in closed containers is extremely detrimental to stability both of pH and product performance.

(2) all compositions prepared with a pH of greater than 9.0 were found to separate into phases after one week at 120° F.

(3) both 30% and 5% solutions in sealed containers were found stable when aged at 72° F. (room temperature).

TABLE 12 gives the results of a dynamic test to simulate the consequences of holding at different temperatures 5% sizing solutions in a slasher bath for periods up to 8 hours. In general, the performance of the sizing compositions was closely related to the pH maintained in the bath and the pH maintenance was directly related to bath temperature. As the temperature of the slasher bath was increased, both pH maintenance and film draw down properties tend to suffer. It is to be noted that pH can be maintained with beneficial results by continual additions of ammonia in water.

TABLE 12

| 30% Solutions With 2% Tyzor TE at 120° F | | | | |
|---|---|---|---|---|
| | | | 72° F Air Dried Films | |
| Initial | pH | 1 Week | Initial | 1 Week |
| 8.55 | | 7.2 | no tack, good adhesion | no tack, good adhesion |
| 9.50 | | 7.5* | no tack, good adhesion | slight tack, good adhesion |
| 10.0 | | 8.5* | no tack, good adhesion | tacky, good adhesion |
| 10.5 | | 9.0* | no tack, good adhesion | tack, good adhesion |

*These solutions proved to be unstable after one week at 120° F.

| 30% Solutions With 2% Tyzor TE at 72° F | | | | |
|---|---|---|---|---|
| | | | 72° F. Air Dried Films | |
| Initial | pH | 1 Week | Initial | 1 Week |
| 8.55 | | 8.25 | no tack, good adhesion | no tack, good adhesion |
| 9.50 | | 9.05 | no tack, good adhesion | slight tack, good adhesion |
| 10.0 | | 9.20 | no tack, good adhesion | slight tack, good adhesion |
| 10.5 | | 10.10 | no tack, good adhesion | slight tack, good adhesion |

| 5% Solutions With 2% Tyzor TE at 72° F | | | | |
|---|---|---|---|---|
| | | | 72° F Air Dried Films | |
| Initial | pH | 1 Week | Initial | 1 Week |
| 8.5 | | 8.8 | tacky, good adhesion | no tack, poor adhesion |
| 9.5 | | 9.65 | no tack, good adhesion | no tack, good adhesion |
| 10.0 | | 10.0 | no tack, good adhesion | no tack, good adhesion |
| 10.5 | | 10.4 | no tack, good adhesion | no tack, good adhesion |

TABLE 13

| Stability of 5% Solution 2% Tyzor TE Under Dynamic Conditions* | | |
|---|---|---|
| Room Temperature (72° F.) | | |
| Time | pH | Film Properties |
| Initial | 8.5 | no tack, good adhesion |
| 4 Hour | 8.6 | no tack, good adhesion |
| 8 Hour | 8.6 | no tack, good adhesion |
| 100–105° F. | | |
| Time | pH | Film Properties |
| Initial | 9.0 | no tack, good adhesion |
| 4 Hour | 8.4 | no tack, good adhesion |
| 8 Hour | 8.3 | no tack, good adhesion |
| 130–135° F. | | |
| Time | pH | Film properties |
| Initial | 8.8 | no tack, good adhesion |
| 4 Hour | 7.7 | slight tack, good adhesion |

TABLE 13-continued

| Stability of 5% Solution 2% Tyzor TE Under Dynamic Conditions* | | |
|---|---|---|
| 8 Hour | 7.1 | slight tack, good adhesion |

*Dynamic conditions correspond to mild agitation approximately equal to that which arises from the movement of warp yarns during sizing.

EXAMPLE 13

Evaluation of a 5% by weight of resin based on total weight of a warp size composition made by the method disclosed in Example 1 on: 100% Dacron Type 56 having 34 filaments of 150 denier, 100% Bright Nylon, type 185 having 34 filaments of 165 denier, and 100% polypropylene having 35 filaments of 165 denier.

The above described Dacron, Nylon, and polypropylene were simultaneously sized in slasher cans containing the above cited 5% warp size composition. The percent size pick-up was approximately 2% for Dacron, 3% for Nylon, and 3.5% for polypropylene. These fibers were then woven on a loom at 120 picks/minute into fabrics having a plain weave of 60 ends/inch by 60 picks/inch.

Subsequent to weaving the fabrics were scoured for 30 minutes in a bath at 160° F. containing 1 gram/liter of Merpol DA (detergent) and 1 gram/liter of soda ash. After wringing out excess and rinsing, the fabric was heat set at 300° F. for 30 seconds.

Both a test based on hand, i.e., stiffness, and that disclosed in Example 3 established the complete removal of all size.

The weaving efficiency was found equal to that of Eastman WD size used as a standard for comparison.

EXAMPLE 14

This is an evaluation of tackiness, blocking tendency, and water resistance of both the warp sizing composition which is given in TABLE 1 of Example 1 and a modification thereof. The modification consists of incorporating into said warp sizing composition a hard resin exemplified by Pentalyn$^R$ 255 sold by Hercules Incorporated, Wilmington, Delaware. One method for incorporating a hard resin into the low molecular weight polyester dissolved in a cosolvent made as disclosed in Example 1 is to dissolve the hard resin, exemplified by Pentalyn$^R$ 255 into the same cosolvent used in Example 1 and blend the two together.

Blocking tendency and tackiness were evaluated by the procedure disclosed in Example 4.

Water resistance was evaluated as a function of percent by weight regain. The percent by weight regained by a sample was determined from that weight increase due to moisture pick-up which occurred immediately following an oven heating at 140° F. for at least 24 hours after said sample had been conditioned at 72° F. and 70% relative humidity for 24 hours. The water dispersion giving rise to the dried film was applied with a 1.5 mil draw down rod.

TABLE 14

| Solution Compositions* | Results** |
|---|---|
| 30% Polyester resin | tacky |
| 10% Polyester resin | slight tackiness |
| 5% Polyester resin | very slight tackiness |
| 28.5%, 0.5% Pentalyn® 255 | slight tackiness |
| 9.5%, 0.5% Pentalyn® 255 | very slight tackiness |
| 4.75%, 0.25% Pentalyn® 255 | non-tacky |
| 25.5%, 4.5% Pentalyn® 255 | non-tacky |
| 8.5%, 1.5% Pentalyn® 255 | non-tacky |

TABLE 14-continued

| Solution Compositions* | Results** |
|---|---|
| 4.25%, 0.75% Pentalyn® 255 | non-tacky |

*All percentages are by weight and based upon the total weight of the water dispersion.
**For explanation of particular results, see Example 4.

The results for tackiness are given in TABLE 14. The solution compositions contain in addition to the polyester resin, made as in Example 1, 1% Tyzor$^R$ TE (based upon the weight of polyester resin) and when indicated Pentalyn$^R$ 255.

It is clear that the addition of a hard resin such as Pentalyn$^R$ 255 significantly reduces tackiness. At about 18% by weight, as based upon the polyester resin, of Pentalyn$^R$ 255, the water dispersion gives rise to a non-tacky film regardless of the non-volatile solution concentration. It is clear that non-tacky films can be obtained from solutions having as low as 5% by weight, as based upon the polyester resin, of Pentalyn$^R$ 255, provided the non-volatile solution concentration is low enough.

TABLE 15

| Moisture Regain | |
|---|---|
| PET Film | % Regain |
| 1 | 0.29 |
| 2 | 0.25 |
| 3 | 0.27 |
| 10% polyester resin on PET Film | |
| 1 | 0.35 |
| 2 | 0.38 |
| 3 | 0.35 |
| 5% polyester resin on PET Film | |
| 1 | 0.32 |
| 2 | 0.30 |
| 3 | 0.34 |
| 25.5% polyester resin, 4.5% Pentalyn 255 on PET Film | |
| 1 | 0.25 |
| 2 | 0.25 |
| 3 | 0.24 |

In TABLE 15, water resistance is established first for the uncoated PET film as a control and then for a coated PET film.

TABLE 16

| Blocking Tendency | |
|---|---|
| Sample | Blocking Behavior* |
| 30% polyester resin | Strong |
| 10% polyester resin | Medium |
| 5% polyester resin | Low |
| 25.5% polyester resin, 4.5% Pentalyn$^{200}$ 255 | Low |
| 8.5% polyester resin, 1.5% Pentalyn® 255 | None |
| 4.25% polyester resin, 0.75% Pentalyn® 255 | None |

*"Strong" indicates that more than three small areas of coating separated from one or the other face of a sample as they were pulled apart. "Medium" indicates that three such areas separated. "Low" indicates only one such area. "None" indicates that no such areas separated as was clear from the fact that no areas of discontinuity in the surface were observed.

In TABLE 16, blocking tendency is reported. Cross-referencing the results as to blocking with both tackiness in TABLE 14 and water resistance or moisture regain in TABLE 15 permits some qualitative direction to be expected in one property from that of another. Clearly both increasing tackiness and/or decreasing water resistance correlate to an increasing blocking tendency.

EXAMPLE 15

This example discloses the stability at 72° F. and 120° F. along with the effect of freezing of a solution having 30% non-volatiles therein which was made according to EXAMPLE 1.

Samples A, B, C, D, and E consisting of 4 oz. samples of the solution prepared as in EXAMPLE 1 were treated as follows:

Sample A was kept at 72° F. throughout.

Sample B was kept at 120° F. throughout.

Sample C was kept at 32° F. and thawed to room temperature (72° F.) only in order to measure viscosity and determine degree of cloudiness of the sample, and thereafter refrozen at 32° F.

Sample D immediately after preparation was subjected to a temperature of 32° F. for 5 days during which the solution solidified and thereafter to a temperature of 72° F., which resulted in the solution thawing.

Sample E immediately after preparation was subjected to a temperature of 32° F. for 5 days during which the solution solidified and thereafter to a temperature of 120° F., which resulted in the solution thawing.

All solutions were stirred briefly before each of the following: i) the viscosity was periodically determined by means of a Brookfield rotating a number 4 spindle at 20 revolutions per minute; ii) each sample was periodically tested according to the procedures set out in EXAMPLE 4. Failure indicates either that 5 mil films had "poor" adhesion to a PET substrate or were "tacky". See EXAMPLE 4 for definitions of "poor" and "tacky". These results are summarized in TABLE 17.

TABLE 17

| Sample: | 72° F. | | 120° F. | | C 32° F. | | D 32° F.-72° F. | | E 32° F.-120° E. | |
|---|---|---|---|---|---|---|---|---|---|---|
| Time Elapsed | pH | Viscosity | pH | Viscosity | pH | Viscosity | pH | Viscosity | pH | Viscosity |
| 1 Week | 8.4 | 140 cps. | 7.55 | 250 cps. | 8.6 | 130 cps. | 8.6 | 130 cps. | 8.6 | 135 cps. |
| 2 Weeks | 8.5 | 145 cps. | 7.35 | 510 cps.* | 8.0 | 110 cps. | 8.9 | 120 cps. | 8.2 | 180 cps. |
| 6 Weeks | 8.4 | 175 cps. | 7.1 | 13400 cps.** | 8.6 | 165 cps. | 8.5 | 180 cps. | 7.5 | 1200 cps. |
| 9 Weeks | 8.2 | 163 cps. | (7.2 | 44500 cps.) | 8.2 | 170 cps. | 8.4 | 185 cps. | 7.4 | 4600 cps. |
| 11 Weeks | 7.9 | 215 cps. | (6.7 | 50500 cps.***) | 8.2 | 168 cps. | 8.1 | 210 cps. | 6.9 | 16600 cps.* |
| 13 Weeks | 8.1 | 265 cps. | — | — | 8.3 | 180 cps. | 8.2 | 210 cps. | 7.1 | 24400 cps. |
| 19 Weeks | 7.9 | 375 cps. | — | — | 8.0 | 205 cps. | 7.8 | 240 cps. | 6.8 | 58000 cps.00 |

*Solution slightly cloudy
**Failure
***Materials solid and no longer water soluble The above disclosed examples are intended to clarify this invention. Variations on them are obvious to ones skilled in the art and are intended to be within the scope of this invention.

The invention which is claimed is:

1. A process for protecting a synthetic fiber comprising the step of sizing said synthetic fiber with an aqueous composition comprising:

(i) about 1% to 50% by weight, as based upon said composition, of a water-dispersible low molecular weight polyester having a number average molecular weight in the range of about 850–2500, and an acid value in the range of about 40–85 milligrams of KOH/gram of said polyester, which polyester comprises:

(1) a non-linear polyester backbone having an acid value in the range of about 5–15 milligrams of KOH/gram of said polyester backbone, said backbone comprising a reaction product of an aliphatic polyol, an aromatic dicarboxylic acid, and a monocarboxylic acid, and (2) pendant moieties of a polycarboxylic acid attached to said polyester backbone by at least one ester linkage, wherein each of said pendant moieties has at least one free carboxylic acid group;

(ii) about 0.5% to 4% by weight, as based upon said polyester, of a chelated titanate, and (iii) a fugitive base, in a quantity sufficient to produce a pH for said aqueous composition in the range of about 7–13.

2. The process of claim 1, wherein said polyol is an aliphatic triol wherein all hydroxyl groups are primary.

3. The process of claim 1, wherein said monocarboxylic acid comprises at least one acid selected from the group consisting of:

(a) $H(CH_2)_nCO_2H$ where n is 3 to 22, and (b) a phenyl derivative of a monocarboxylic acid having the formula:

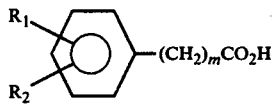

where:

$R_1$ is a hydrogen, an aliphatic group of up to eight carbon atoms, or an aryl group, and $R_2$ is a hydrogen, a chlorine, or a bromine, and m is 1 to 12.

4. The process of claim 2, wherein a ratio for the total equivalents of hydroxyl groups in said aliphatic triol to the total equivalents of acyl groups in said monocarboxylic acid and said aromatic dicarboxylic acid is in the range of about 1.3:1 to about 1.6:1.

5. The process of claim 4, wherein a ratio for the equivalents of acyl groups in said monocarboxylic acid to the equivalents of acyl groups in said aromatic dicarboxylic acid is in the range of about 0.30:1 to about 0.48:1.

6. The process of claim 4, wherein a ratio for total equivalents of hydroxyl groups in all said polyol prior to being incorporated into said polyester to total equivalents of all acyl groups in said polyester is in the range of about 1:1 to about 1.2:1.

7. The process of claim 4, wherein said dicarboxylic acid comprises at least one acid selected from the group consisting of phthalic acid, isophthalic acid, and terephthalic acid.

8. The process of claim 1, wherein said synthetic fiber is selected from the group consisting of polycarbonamides, polyesters, and polyolefins.

9. The process of claim 1, wherein after said synthetic fiber has been sized, said fabric is readily desized by means of a basic aqueous scour.

* * * * *

UNITED STATES PATENT OFFICE

CERTIFICATE OF CORRECTION

Patent No. 4,145,461 Dated March 20, 1979

Inventor(s) Michael A. Lerman and John C. Lark

It is certified that error appears in the above-identified patent and that said Letters Patent are hereby corrected as shown below:

| Patent Column | Line | |
|---|---|---|
| 5 | 47 | "in in" should be --is in-- |
| 8 | 27 | "extent in the" should be --extent the-- |
| 8 | 29 | "ability" should be --stability-- |
| 13 | 37-38 | "of Pelargonic Acid Twice" should be --of Pelargonic Acid to Twice-- |
| 13 | 37-39 | " Dispersion Air Drying (72°F) Characteristics of Film" should be --Air Drying (72°F) Characteristics of Film-- |
| 13 | 38-39 | "Characteristics" should be -- Dispersion Characteristics-- |

UNITED STATES PATENT OFFICE

CERTIFICATE OF CORRECTION

Patent No. 4,145,461 Dated March 20, 1979

Inventor(s) Michael A. Lerman and John C. Lark

It is certified that error appears in the above-identified patent and that said Letters Patent are hereby corrected as shown below:

| Patent Column | Line | |
|---|---|---|
| 14 | 18 | "**" should be --*-- |
| 14 | 64 | "white very poor opaque tacky" should be --white very poor opaque tacky-- |
| 16 | 68 | "TABLES 12 and 18" should be --TABLES 12 and 13-- |
| 19 | 62 | "Pentalyn 200 255" should be --Pentalyn R 255-- |

Table 17 Heading "72°F. should be --A 72°F.--

Table 17 Heading "120°F." should be --B 120°F.--

UNITED STATES PATENT OFFICE

CERTIFICATE OF CORRECTION

Patent No. 4,145,461 Dated March 20, 1979

Inventor(s) Michael A. Lerman and John C. Lark

It is certified that error appears in the above-identified patent and that said Letters Patent are hereby corrected as shown below:

| Patent Column | Line | |
|---|---|---|
| Table 17 | Heading | "E 32°F.-120°E." should be --E 32°F-120°F.-- |
| Table 17 | Last Column | "58000 cps.00" should be --58000 cps.**-- |

Signed and Sealed this

*Fifteenth* Day of *July 1980*

[SEAL]

*Attest:*

SIDNEY A. DIAMOND

*Attesting Officer*

*Commissioner of Patents and Trademarks*